US006960880B2

(12) United States Patent
Chien et al.

(10) Patent No.: US 6,960,880 B2
(45) Date of Patent: Nov. 1, 2005

(54) ELECTRODE PAIR STRUCTURE OF A PLASMA DISPLAY PANEL

(75) Inventors: Yu-Ting Chien, Taipei Hsien (TW); Jih-Fon Huang, Hsin-Chu Hsien (TW)

(73) Assignee: AU Optronics Corp., Hsin-Chu (TW)

( * ) Notice: Subject to any disclaimer, the term of this patent is extended or adjusted under 35 U.S.C. 154(b) by 128 days.

(21) Appl. No.: 10/249,489

(22) Filed: Apr. 14, 2003

(65) Prior Publication Data

US 2004/0027068 A1 Feb. 12, 2004

(30) Foreign Application Priority Data

Aug. 9, 2002 (TW) ..... 91118045 A

(51) Int. Cl.[7] ..... H01J 17/49

(52) U.S. Cl. ..... 313/582; 313/583; 313/586; 313/292

(58) Field of Search ..... 313/582–587, 313/631, 292, 268

(56) References Cited

U.S. PATENT DOCUMENTS 6,522,072 B1 * 2/2003 Yura et al. ..... 313/582
6,646,377 B2 * 11/2003 Hashimoto ..... 313/582
6,747,409 B1 * 6/2004 Han et al. ..... 313/582

FOREIGN PATENT DOCUMENTS

TW 466526 12/2001

* cited by examiner

*Primary Examiner*—Karabi Guharay
*Assistant Examiner*—Sikha Roy
(74) *Attorney, Agent, or Firm*—Winston Hsu

(57) ABSTRACT

An electrode pair structure of a plasma display panel (PDP). The electrode pair structure includes a first metal electrode, and a second metal electrode in parallel with the first metal electrode, installed on a front substrate. The first metal electrode and the second metal electrode are both composed of a series of hollow and hexagonal metal structures.

26 Claims, 11 Drawing Sheets

ELECTRODE PAIR STRUCTURE OF A PLASMA DISPLAY PANEL

BACKGROUND OF INVENTION

1. Field of the Invention

The present invention relates to an electrode pair structure of a plasma display panel (PDP), and more particularly, to an electrode pair structure of a PDP that includes a pair of metal electrodes, and each metal electrode is composed of a series of hollow, multilateral, and annular metal structures.

2. Description of Related Art

A display device generally falls into two categories, which are the cathode ray tube and the flat panel display. Furthermore, the flat panel display has various types, such as the liquid crystal display (LCD), the plasma display panel (PDP), or the field emission display (FED). Since the PD has many beneficial characteristics such as being thin, having a lightweight design, having large display sizes, giving off no irradiation, and having a wide viewing angle, the PDP has been used widely in the large scale full-color display field.

Referring to FIGS. 1 and 2, FIG. 1 is a schematic diagram of a conventional PDP 10, and FIG. 2 is a cross-sectional view of the PDP 10 along line 2–2', shown in FIG. 1. As shown in FIG. 1, the conventional PDP 10 mainly includes a front substrate 12, a rear substrate 14 positioned parallel with the front substrate 12, and a discharge gas 16 formed between the front substrate 12 and the rear substrate 14. In addition, the PDP 10 includes at least one electrode pair 18 positioned on a lower, surface of the front substrate 12, a black matrix (BM) layer 20 positioned on the lower surface of the front substrate and outside the electrode pair 18 for increasing the image contrast, a transparent dielectric layer 22 positioned on the electrode pair 18 and the BM layer 20, and a passivation layer 24 positioned on the transparent dielectric layer 22 for preventing ions of the discharge gas 16 from colliding with the transparent dielectric layer 22 and the electrode pair 18, and increasing the life of the PDP 10.

Moreover, the electrode pair 18 is composed of two electrodes 18*a* and 18*b* in parallel with each other, and a discharge gap 26 is formed between the two electrodes 18*a* and 18*b*. Further, the electrode 18*a* includes a sustaining electrode 28*a* and a bus electrode 30*a* positioned outside the sustaining electrode 28*a*. Likewise, the electrode 18*b* includes a sustaining electrode 28*b* and a bus electrode 30*b* positioned outside the sustaining electrode 28*b*. Typically, the sustaining electrodes 28*a* and 28*b* both function as transparent electrodes of the PDP 10 and are composed of indium tin oxide (ITO) or stannum dioxide ($SnO_2$). The transparent electrodes are previous to light, but have a large resistance value. The bus electrodes 30*a* and 30*b* both function as opaque electrodes of the PDP 10 and are composed of metallic materials, such as chromium/copper/chromium (Cr/Cu/Cr) or silver (Ag). The opaque electrodes are not previous to light, but have excellent electric conductivity for assisting the transparent electrodes to conduct electricity.

In addition, the PDP 10 includes a plurality of address electrodes 32, namely data electrodes, positioned perpendicularly to the sustaining electrodes 28*a* and 28*b* and on an upper surface of the rear substrate 14, a white reflective dielectric layer 34 positioned on the upper surface of the rear substrate 14 and covering the address electrodes 32, a plurality of parallel ribs 36 positioned between two adjacent address electrodes 32 and on the white reflective dielectric layer 34, red/green/blue fluorescence layers 38R/38G/38B coated between two adjacent ribs 36 and on the white reflective dielectric layer 34, and two sidewalls of each rib 32, respectively. The white reflective dielectric layer 34 is used to raise reflection of the visible light, increase the brightness of the PDP 10, and planarize the surface of the rear substrate 14. When the discharge gas 16 is excited and dissociated, ultraviolet (UV) ray is generated to irradiate the fluorescence layers 38R/38G/38B to generate red/green/blue beams, respectively.

In the method for forming the transparent electrodes, a physical sputtering process is performed to form a transparent conductive metal layer on the front substrate, and then an etching process is performed to form a desired pattern of the transparent electrodes in the transparent conductive metal layer. However, the shape and the thickness of the transparent electrodes have to be controlled precisely under the demands of the PDP being of large scale and having a high resolution, and the transparent electrodes have disadvantages of the larger resistance value and will reduce the brightness of the PDP. Therefore, a PDP that ignores the transparent electrodes has been disclosed to reduce cost and to increase yield of the PDP.

Referring to FIG. 3, it is a chematic diagram of another conventional PDP 40. The PDP 40 ignores the transparent electrodes of the PDP 10, and only utilizes the opaque electrodes positioned on the surface of the front substrate as the electrode pair of the PDP 40. Also, opaque bus electrodes with fence structures are utilized in the PDP 40 to replace the conventional opaque bus electrodes with slit structures of the FDP 10.

As shown in FIG. 3, the PDP 40 includes at least one fence-shaped metal electrode pair 42 positioned on a lower surface of a front substrate (not shown in FIG. 3), and a plurality of address electrodes 44, which are positioned perpendicularly with respect to the metal electrode pair 42, positioned between the ribs (not shown in FIG. 3) and on an upper surface of a rear substrate (not shown in FIG. 3) of the PDP 40. The metal electrode pair 42 is composed of two fence-shaped metal electrodes 42*a* and 42*b* in parallel with each other. Moreover, the metal electrodes 42*a* and 42*b* are both composed of three horizontal electrodes 46*a* and a plurality of vertical electrodes 46*b* connected to the three horizontal electrodes 46*a,* respectively. Furthermore, a width H2 of each metal electrode 42*a* or 42*b* is substantially equal to a width H1 of each transparent electrode 28*a* shown in FIG. 2. The vertical electrodes 46*b* are used to prevent the metal electrodes 42*a* and 42*b* from short-circuiting, since the horizontal electrodes 46*a* are cut off in the manufacturing process for forming the metal electrodes 42*a* and 46*b* or by an improper external force pressing the horizontal electrodes 46*a*. Therefore, the current can flow through the continuous vertical electrodes 46*b,* not the discontinuous horizontal electrodes 46*a,* to avoid the above-mentioned problems. In addition, the vertical electrodes 46*b* can be formed on the front substrate corresponding to the underlying ribs of the rear substrate (not shown in FIG. 3) to prevent affecting the brightness of the PDP 40.

The conventional PDP 40 ignores the transparent electrodes and forms the fence-shaped metal electrodes 42*a* and 42*b* on the front substrate directly, so as to decrease the process of forming the transparent electrodes, reduce cost, and lower the complexity of the process. However, the electrode areas of the fence-shaped metal electrodes 42*a* and 42*b* are too large, so as to shield the discharge area too much, and cause the display brightness of the PDP to be lowered substantially. Therefore, the fence-shaped metal electrodes 42*a* and 42*b* are not suitable for application in mass production of the PDP.

Since the widths of the horizontal electrodes 46*a* and the vertical electrode 46*b* of the PDP 40 are very narrow, the horizontal electrodes 46*a* and the vertical electrode 46*b* could be cut off easily during the manufacturing process, which leads to the short-circuiting phenomenon. Because of the limitation of the photolitbographic process, when increasing the resolution of the PDP, the fence-shaped metal electrodes with small line width are very difficult to form and control. On the other hand, if the line width of the metal electrode remains wider, the shielding area of the metal electrodes will increase so as to reduce the brightness of the PDP.

SUMMARY OF INVENTION

It is therefore a primary objective of the claimed invention to provide an electrode pair structure of a PDP that ignores transparent electrodes.

It is another object of the claimed invention to provide a multilateral metal electrode pair structure positioned on a front substrate of a PDP.

It is another object of the claimed invention to provide an electrode pair structure to prevent from affecting the display brightness and raising the yield of a PDP.

According to the preferred embodiment of the claimed invention, an electrode pair structure of a PDP is introduced. The electrode pair structure is formed on a bottom side of a front substrate of the FDP. The electrode pair structure comprises a first metal electrode installed on the front substrate and composed of a series of hollow and hexagonal metal structures, and a second metal electrode installed on the front substrate in parallel with the first metal electrode, and composed of a series of hollow and hexagonal metal structures. The first metal electrode and the second metal electrode are identical.

The PDP of the claimed invention, which ignores the conventional transparent electrode, forms the metal electrode pair structure composed of a plurality of hollow, multilateral, and annular metal structures on the surface of the front substrate to replace the conventional electrode pair structure that is composed of the transparent electrode and the bus electrode, so as to reduce the process complexity and the cost, and prevent from affecting the contrast and the brightness of the PDP.

These and other objectives of the claimed invention will no doubt become obvious to those of ordinary skill in the art after reading the following detailed description of the preferred embodiment that is illustrated in the various figures and drawings.

DETAILED DESCRIPTION

Figure 1:
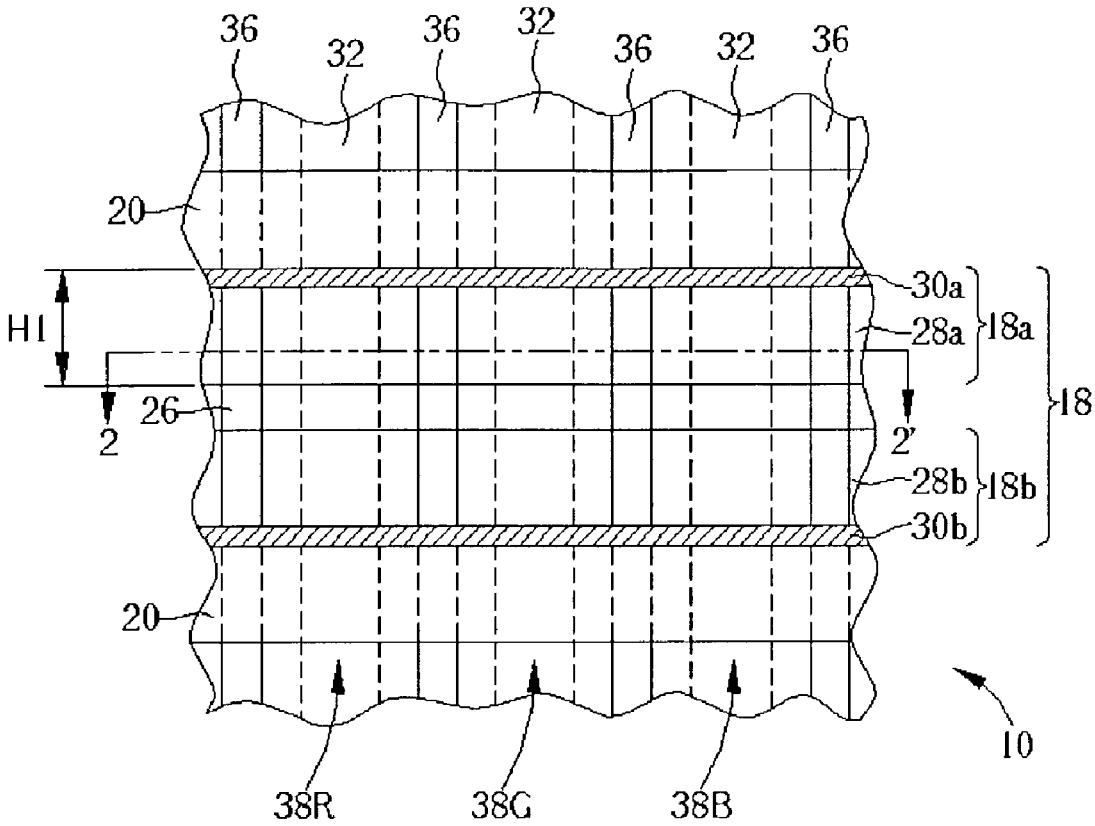
Fig. 1 Prior art
FIG. 1 is a schematic diagram of a conventional PDP.
Figure 2:
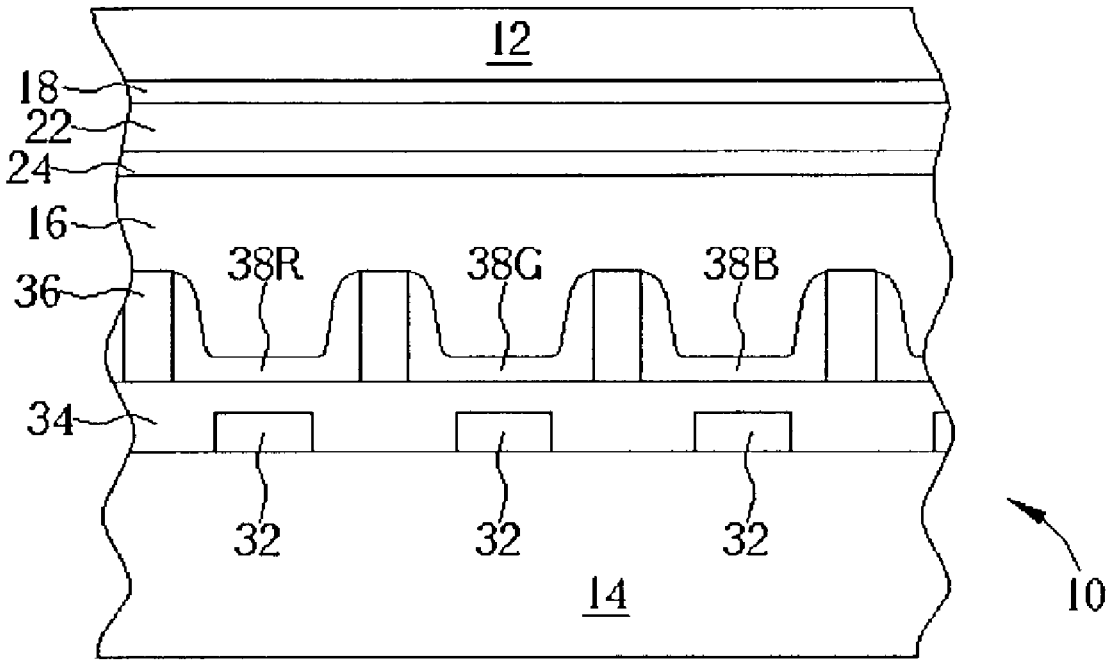
Fig. 2 Prior art
FIG. 2 is a cross-sectional view of the PDP along line 2–2" shown in FIG. 1.
Figure 3:
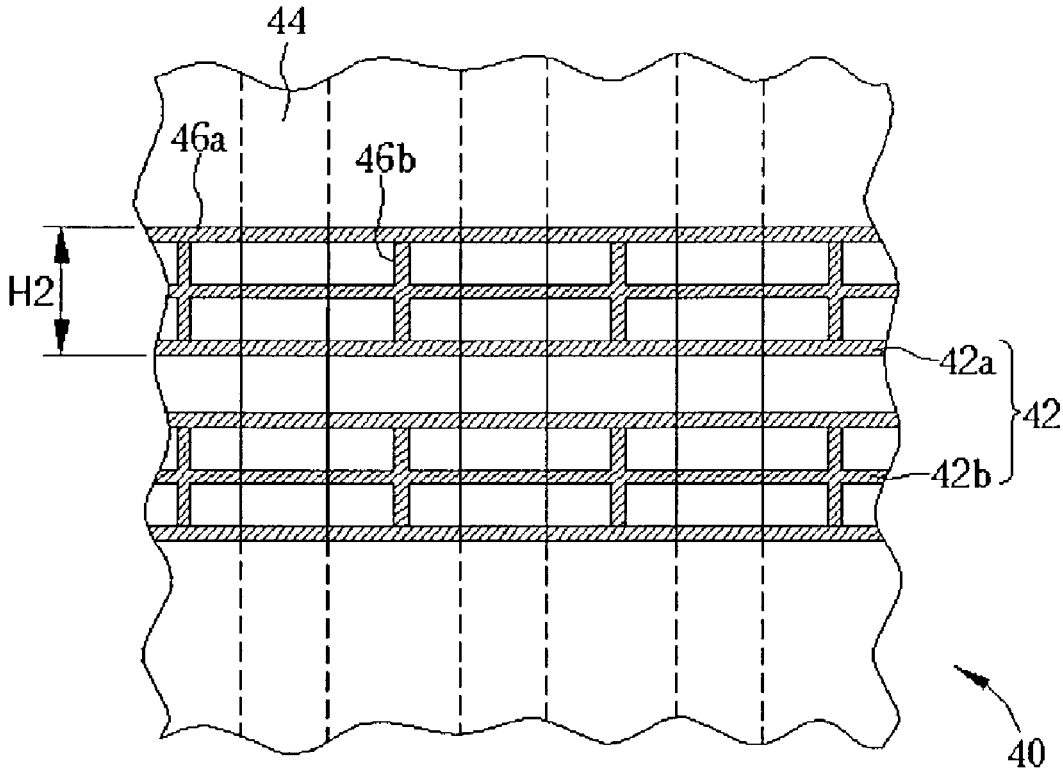
Fig. 3 Prior art
FIG. 3 is a schematic diagram of another conventional PDP.
Figure 4:
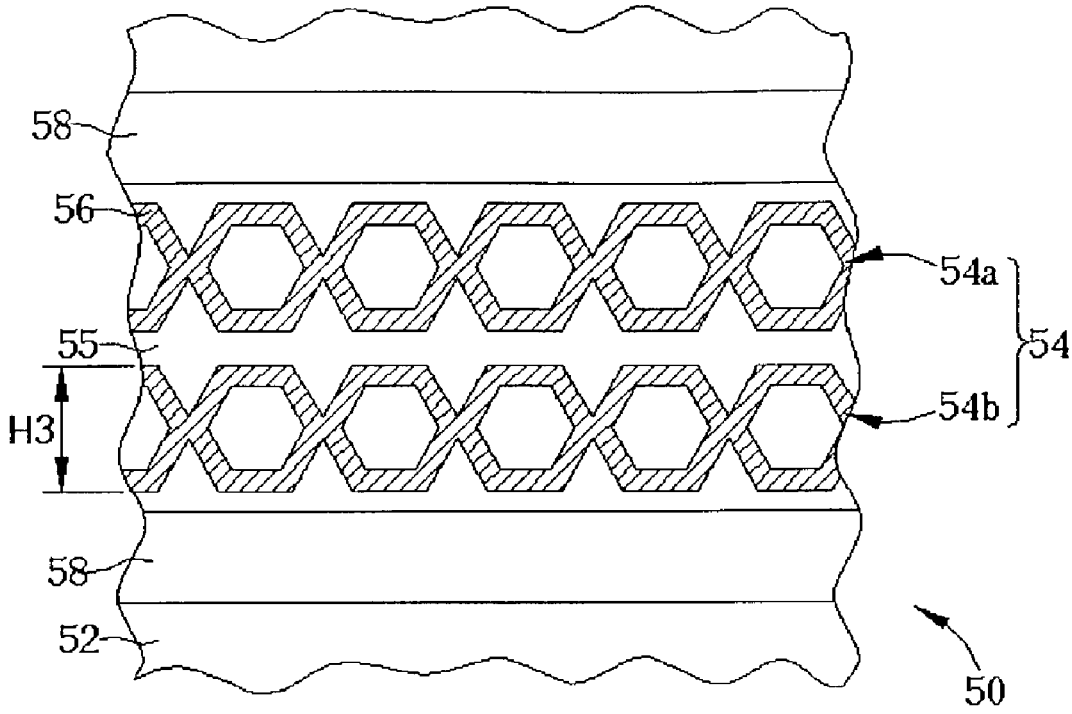
FIG. 4 is a top view of a front substrate of a PDP according to the present invention.
Figure 5:
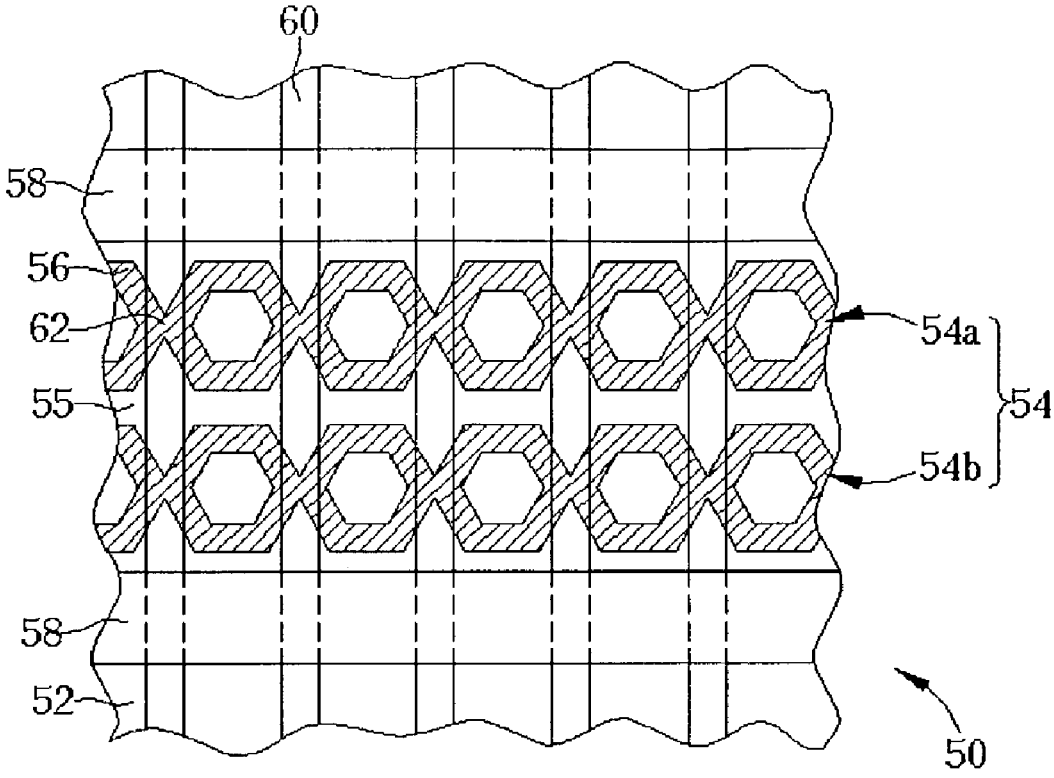
FIG. 5 is a perspective top view of the PDP according to the present invention.

Referring to FIGS. 4 and 5, FIG. 4 is a top view of a front substrate 52 of a PDP 50 according to the present invention. FIG. 5 is a perspective top view of the PDP 50 according to the present invention. As shown in FIG. 4, the PDP 50 includes at least one opaque metal electrode pair 54 positioned on a bottom side of the front substrate 52 of the PDP 50. The metal electrode pair 54 is composed of two metal electrodes 54*a* and 54*b* in parallel with the first metal electrode 54*a*, and a discharge gap 55 is formed between the two metal electrodes 54*a* and 54*b*. Moreover, the metal electrodes 54*a* and 54*b* are both composed of a series of hollow and hexagonal metal structures 56, and each hollow and hexagonal metal structure 56 is adjoined with the adjacent hollow and hexagonal metal structures 56 along a major axis of the metal electrodes 54*a* and 54*b*. In addition, the PDP 50 includes a BM layer 58 positioned on the bottom side of the front substrate 52 and outside the metal pair electrode 54, a transparent dielectric layer, and a passivation layer (both not shown in FIG. 4) formed on the front substrate 52, respectively, to cover the metal electrodes 54*a* and 54*b* and the BM layer 58.

Typically, the metal electrodes 54*a* and 54*b* are both composed of Cr/Cu/Cr or silver (Ag). The method of forming the metal electrodes 54*a* and 54*b* is utilizing a sputtering process or an electron beam evaporating process to form the three metal layers on the front substrate 52, and then performing an etching process to form a desired pattern of the metal electrodes 54*a* and 54*b*. Additionally, a screen with the desired pattern can be utilized to perform a thick film printing process to print silver electrode pastes on the front substrate 52 to form the metal electrodes 54*a* and 54*b*. The internal diameter (ID) of each hollow metal structure 56 is approximately 150 to 180 micrometers ($\mu$m), and 164 $\mu$m is preferred.

As shown in FIG. 5, the PDP 50 also includes a rear substrate (not shown in FIG. 5) positioned parallel with the front substrate 52. The rear substrate comprises a plurality of ribs 60 positioned on an upper side of the rear substrate, and the ribs 60 are essentially parallel to a major axis direction of the metal electrodes 54*a* and 54*b*. Typically, the front substrate 52 and the rear substrate are both transparent glass substrates. In particular, a joint portion 62 of two adjacent metal structures 56 corresponds to an underlying rib 60 so as to prevent from affecting the display brightness of the PDP 50, and a width of the joint portion 62 is larger than a width of each rib 60 so that the discharge region can be extended through the metal electrodes 54*a* and 54*b* outside the ribs 60.

Figure 6:
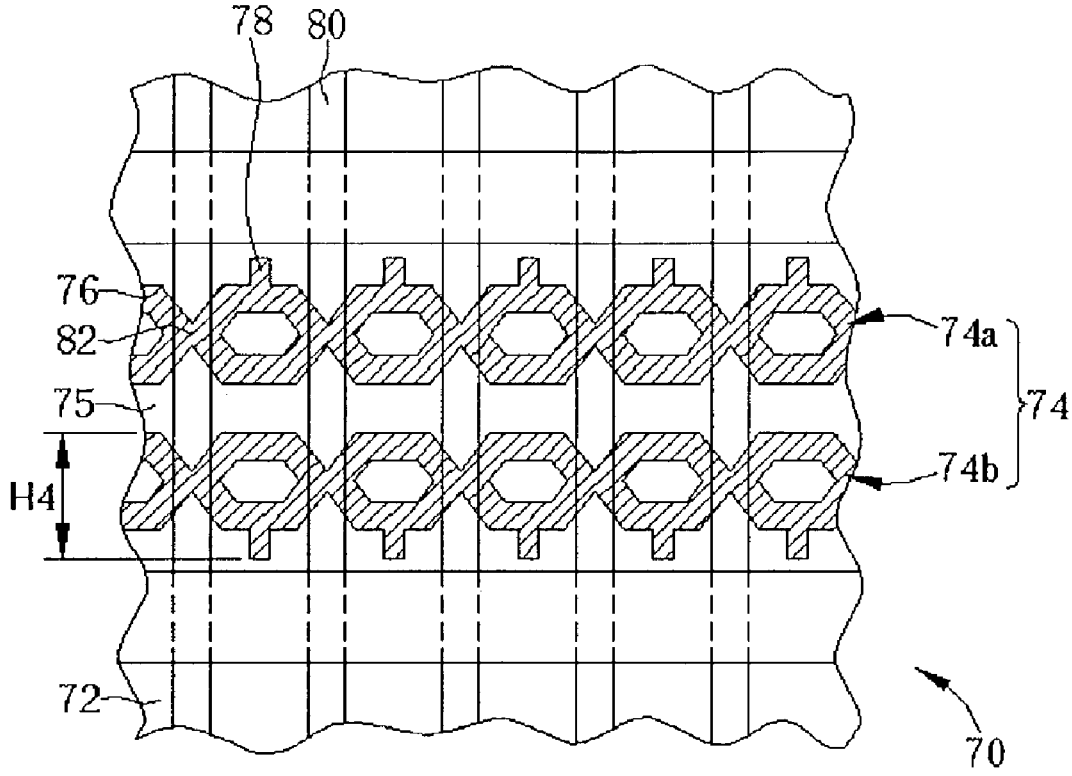
FIG. 6 is a perspective top view of another PDP according to the present invention.
Figure 7:
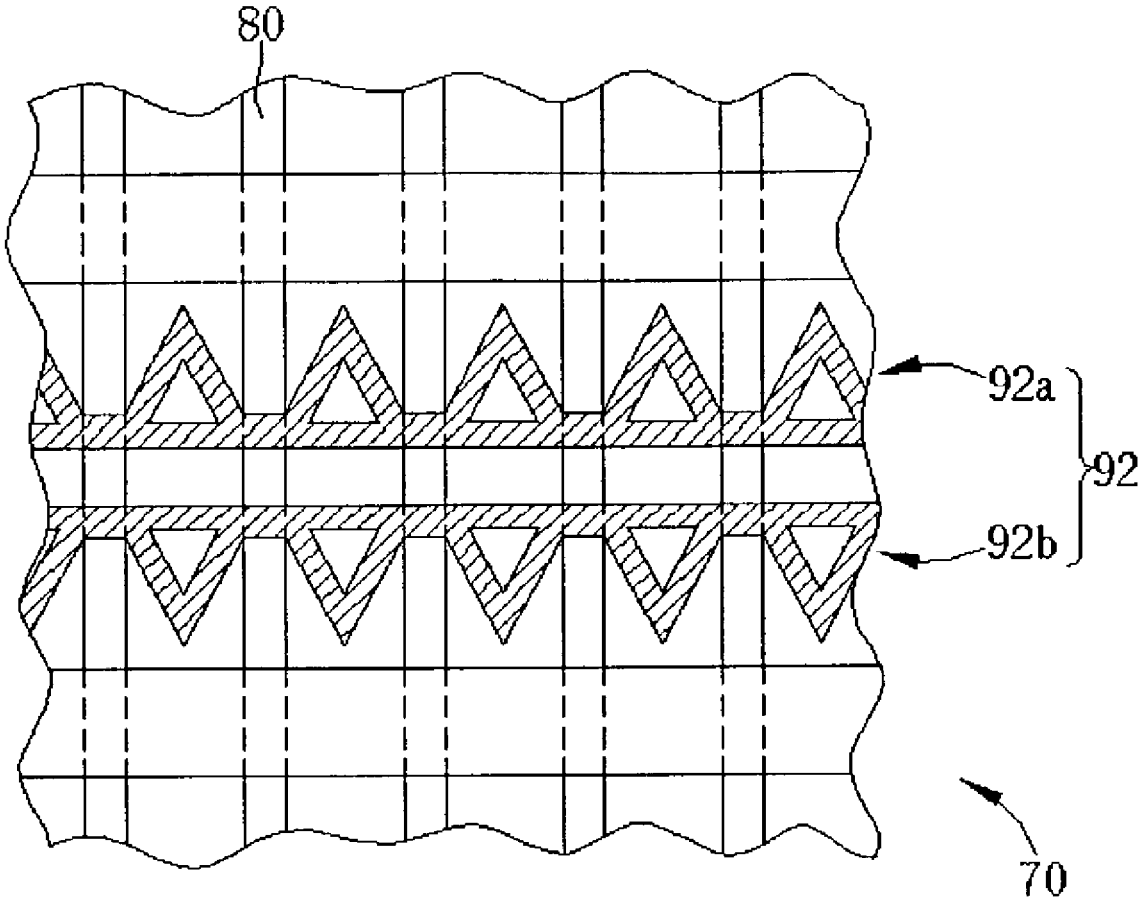
FIG. 7 to FIG. 11 are schematic diagrams of various kinds of metal electrode pairs according to the present invention.
Figure 8:
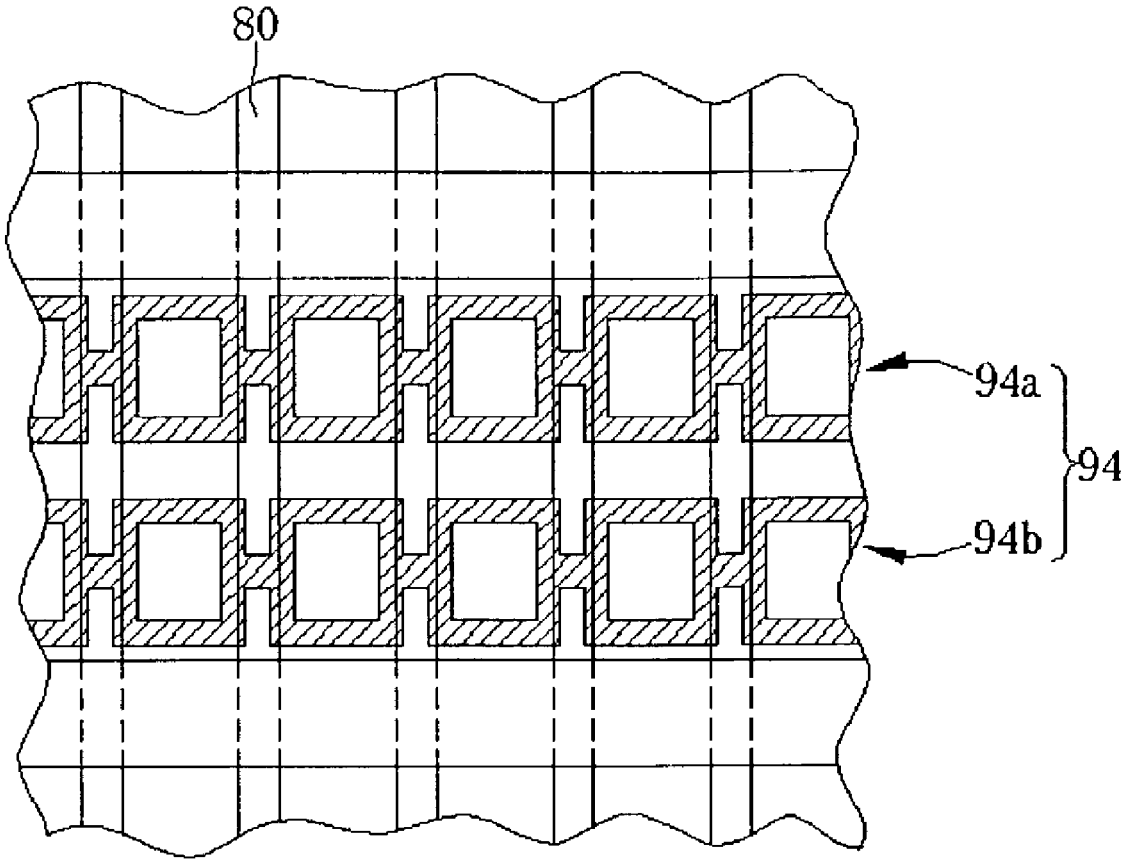
Figure 9:
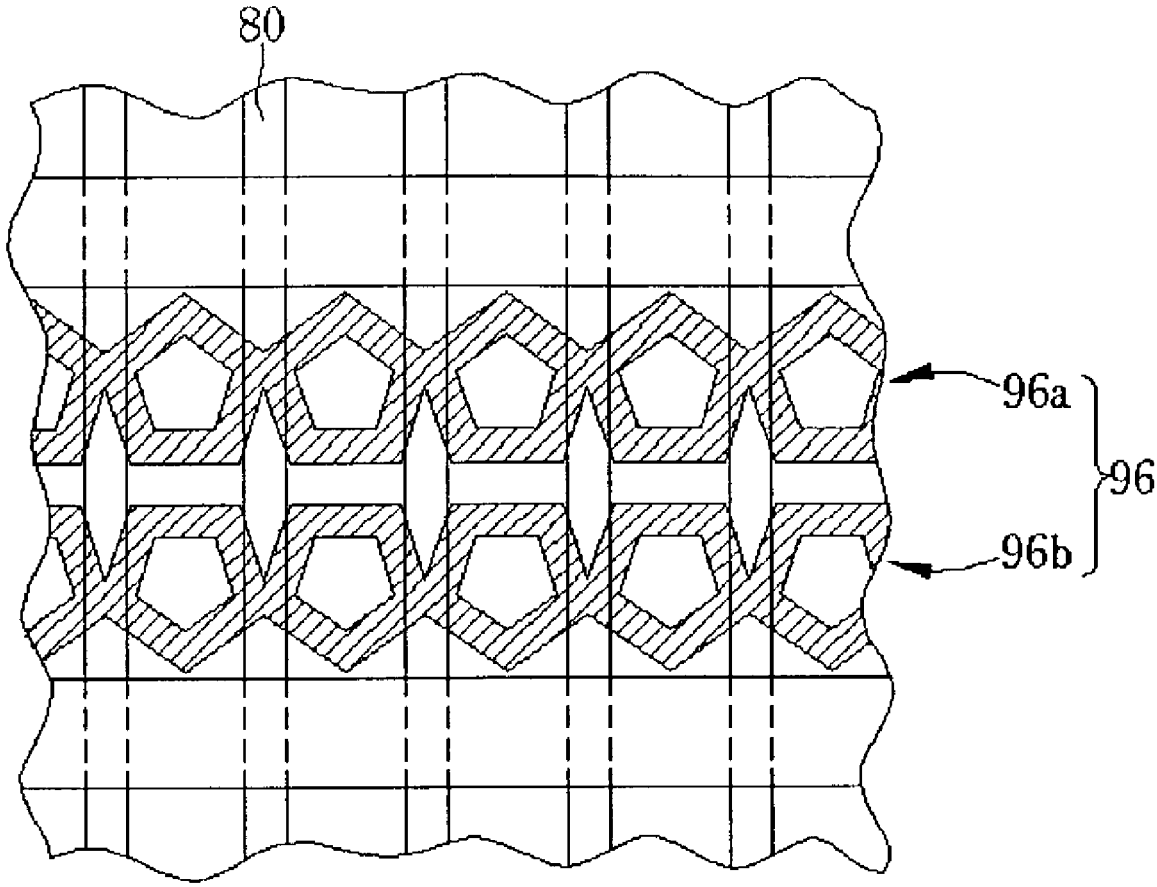
Figure 10:
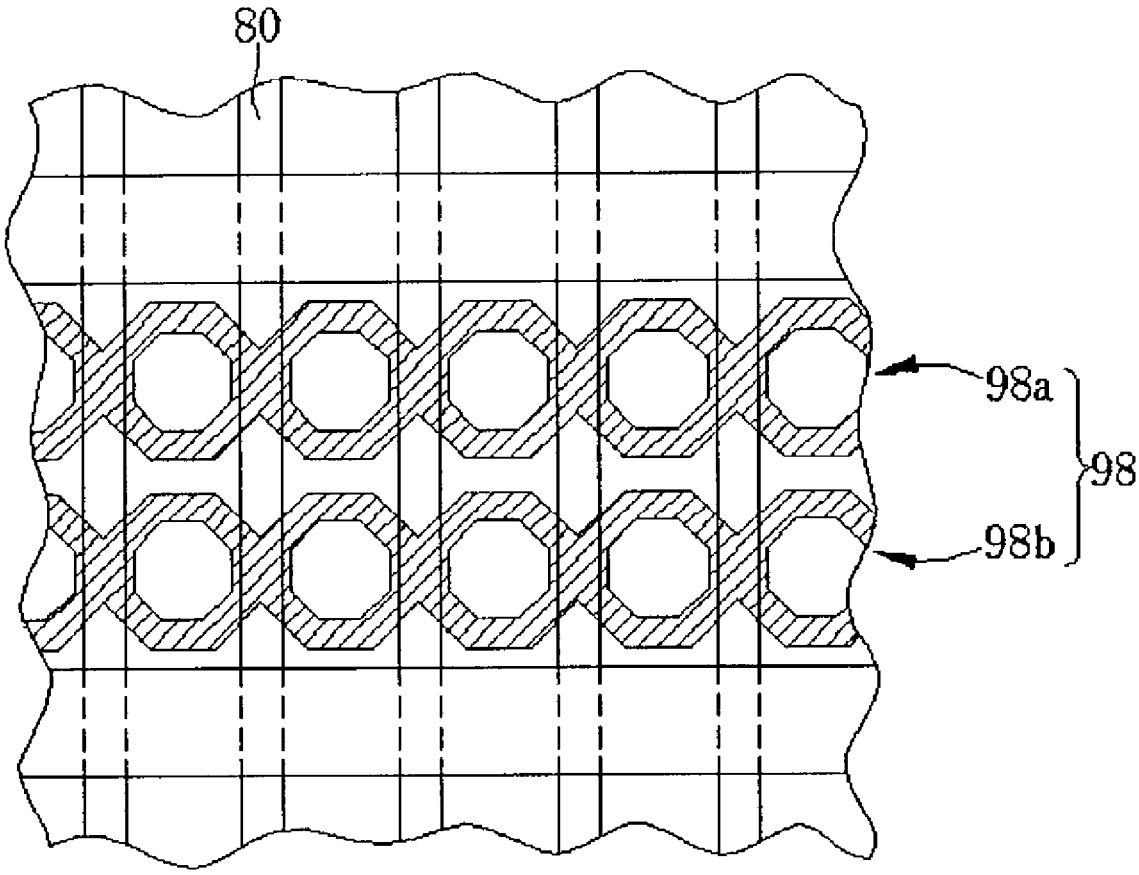
Figure 11:
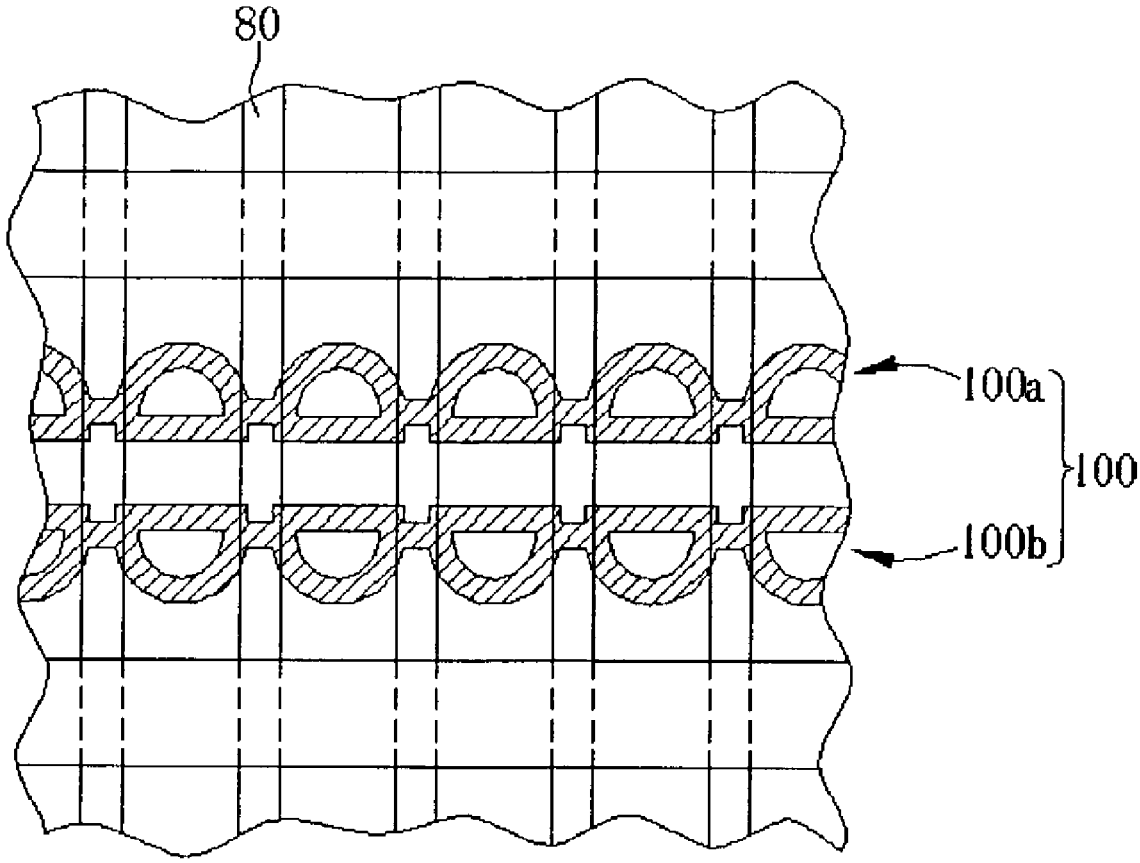

Referring to FIG. 6, it is a perspective top view of another PDP 70 according to the present invention. As shown in FIG. 6, the PDP 70 includes at least one opaque metal electrode pair 74 positioned on a bottom side of a front substrate 72 of the PDP 70. The metal electrode pair 74 is composed of two metal electrodes 74*a* and 74*b* in parallel with the first metal electrode 74*a*, and a discharge gap 75 is formed between the two metal electrodes 74*a* and 74*b*. Moreover, the metal electrodes 74*a* and 74*b* are both composed of a series of hollow and hexagonal metal structures 76, and each hollow and hexagonal metal structure 76 is adjoined with the adjacent hollow and hexagonal metal structures 76 along a major axis of the metal electrodes 74*a* and 74*b*, and each metal structure 76 has a protrusion 78 positioned on a side away from the discharge gap 75 for extending a discharge area of the electrode pair 74. The protrusions 78 and the metal structures 76 are composed of the same materials. Since the metal structures 76 have a shorter ID than the metal structures 56 shown in FIG. 4, the PDP 70 can have a lower operating voltage applied to it. Generally, a width H3 of each metal structure 56 shown in FIG. 4 is substantially equal to a width H4 that is added from each metal structure 76 and each protrusion 78. An ID of each hollow metal structure 76 is approximately between 90 to 120 $\mu$m, and 104 $\mu$m is preferred. Furthermore, a width of each protrusion 78 is approximately between 50 to 70 $\mu$m, and 64 $\mu$m is preferred.

In addition, the PDP 70 also includes a rear substrate (not shown in FIG. 6) positioned parallel with the front substrate 72. The rear substrate comprises a plurality of ribs 80 positioned on an upper side of the rear substrate, and the ribs 80 are essentially parallel to a major axis direction of the metal electrodes 74*a* and 74*b*. In particular, a joint portion 82 of two adjacent metal structures 76 corresponds to an underlying rib 80 so as to prevent from affecting the display brightness of the PDP 70, and a width of the joint portion 82 is larger than a width of the rib 80 so that the discharge region can be extended through the metal electrodes 74*a* and 74*b* outside the ribs 80.

Although the embodiments of the present invention utilize the hollow and hexagonal metal structures 56 and 76 as examples for explanation, the present invention is not limited to these. Various kinds of hollow, multilateral, and annular metal structures can be applied in the present invention, as long as the metal structures have a fixed discharge gap, a joint portion of two adjacent metal structures corresponds to an underlying rib, and a width of the joint portion is larger than a width of each rib. Ear example, as shown in FIGS. 7 to 11, a triangular metal electrode pair 92, a quadrilateral metal electrode pair 94, a pentagonal metal electrode pair 96, an octagonal metal electrode pair 98, and a semicircular metal electrode, pair 100 all can be applied in the PDP of the present invention. In addition, the metal electrode pair of the present invention can be composed of two parallel metal electrodes, but the two metal electrodes are not identical.

To sum up, the PDP of the present invention, which ignores the conventional transparent electrode, forms the metal electrode pair including the two metal electrodes composed a plurality of hollow, multilateral, and annular metal structures, on the surface of the front substrate directly. Therein, each hollow, multilateral, and annular metal structure is adjoined with the adjacent hollow, multilateral, and annular metal structures along a major axis of the two metal electrodes. Since the metal structures are hollow and multilateral, the area of the metal electrodes can be reduced so as to raise the display brightness, reduce discharge current, and increase discharge efficiency. Furthermore, the protrusion positioned on a side away from the discharge gap can be used to extend the discharge area of the metal electrode pair. In addition, the display brightness and the aperture ratio of the PDP cannot be affected, the power can be saved, and the operating voltage can be reduced.

In comparison with the conventional PDP, the present invention ignores the transparent electrodes and utilizes the metal electrode pair composed of a plurality of hollow, multilateral, and annular metal structures to replace the conventional slit-shaped electrode pair and the fence-shaped metal pair, so as to reduce the process complexity, lower the production cost, prevent from affecting the display brightness and the contrast of the PDP, and raise the product yield.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. An electrode pair structure of a plasma display panel (PDP) being formed on a bottom side of a front substrate of the PDP, the electrode pair structure comprising:

a first metal electrode installed on the front substrate, the first metal electrode being composed of a series of hollow and hexagonal metal structures, each hollow and hexagonal metal structure being adjoined with the adjacent hollow and hexagonal metal structures along a major axis; and a second metal electrode installed on the front substrate in parallel with the first metal electrode, the second metal electrode being composed of a series of hollow and hexagonal metal structures, each hollow and hexagonal metal structure being adjoined with the adjacent hollow and hexagonal metal structures along the major axis;

wherein the first metal electrode and the second metal electrode are identical.

2. The electrode pair structure of claim 1 wherein the PDP further comprises a rear substrate positioned parallel to the front substrate, the rear substrate comprises a plurality of ribs formed on an upper side of the rear substrate, and the ribs are essentially parallel perpendicular to the major axis direction of the first metal electrode.

3. The electrode pair structure of claim 2 wherein the front substrate and the rear substrate are both transparent glass substrates.

4. The electrode pair structure of claim 2 wherein a joint portion of two adjacent metal structures corresponds to an underlying rib, and a width of the joint portion is larger than a width of the rib.

5. The electrode pair structure of claim 1 wherein a transparent electrode does not exist between the first metal electrode, the second metal electrode, and the front substrate.

6. The electrode pair structure of claim 1 wherein the first metal electrode and the second metal electrode are both composed of chromium/copper/chromium (Cr/Cu/Cr) or silver (Ag).

7. The electrode pair structure of claim 1 wherein a shortest distance between the first metal electrode and the second metal electrode is a discharge gap of the electrode pair structure.

8. The electrode pair structure of claim 7 wherein each of the metal structures further comprises a protrusion formed on a side away from the discharge gap for extending a discharge area of the electrode pair structure.

9. The electrode pair structure of claim 7 wherein the discharge gap between each metal structure of the first metal electrode and each metal structure of the second metal electrode is substantially equal.

10. An electrode pair structure of a plasma display panel (PDP) being formed on a bottom side of a front substrate of the PDP, the electrode pair structure comprising:

a first metal electrode installed on the front substrate, the first metal electrode being composed of a series of multilateral and annular first metal structures, each multilateral and annular first metal structure being adjoined with the adjacent multilateral and annular first metal structures along a major axis; and a second metal electrode installed on the front substrate in parallel with the first metal electrode, the second metal electrode being composed of a series of multilateral and annular second metal structures, each multilateral and annular second metal structure being adjoined with the adjacent multilateral and annular second metal structures along the major axis;

wherein a discharge gap between each first metal structure and a corresponding second metal structure is substantially equal.

11. The electrode pair structure of claim 10 wherein the PDP further comprises a rear substrate positioned parallel to the front substrate, the rear substrate comprises a plurality of ribs formed on an upper side of the rear substrate, and the ribs are essentially perpendicular to the major axis direction of the first metal electrode.

12. The electrode pair structure of claim 11 wherein the front substrate and the rear substrate are both transparent glass substrates.

13. The electrode pair structure of claim 11 wherein a joint portion of two adjacent first metal structures and a joint portion of two adjacent second metal structures both correspond to underlying ribs, and a width of the joint portions is larger than a width of the ribs.

14. The electrode pair structure of claim 10 wherein a transparent electrode does not exist between the first metal electrode, the second metal electrode, and the front substrate.

15. The electrode pair structure of claim 10 wherein the first metal electrode and the second metal electrode are both composed of chromium/copper/chromium (Cr/Cu/Cr) or silver (Ag).

16. The electrode pair structure of claim 10 wherein a shortest distance between the first metal electrode and the second metal electrode is a discharge gap of the electrode pair structure.

17. The electrode pair structure of claim 16 wherein each of the first metal structures and the second metal structures further comprises a protrusion formed on a side away from the discharge gap for extending a discharge area of the electrode pair structure.

18. The electrode pair structure of claim 16 wherein the discharge gap between each metal structure of the first metal electrode and each metal structure of the second metal electrode is substantially equal.

19. The electrode pair structure of claim 10 wherein the first metal structures and the second metal structures both comprise triangular metal structures, quadrilateral metal structures, pentagonal metal structures, hexagonal metal structures, octagonal metal structures or semicircular metal structures.

20. A plasma display panel (PDP) comprising:

a rear substrate;

a plurality of ribs parallel with each other, positioned along a first direction and on an upper side of the rear substrate;

a front substrate positioned on and parallel with the rear substrate; and at least one electrode pair structure positioned on a bottom side of the front substrate along a second direction, the electrode pair structure comprising:

a first metal electrode installed on the front substrate, the first metal electrode being composed of a series of multilateral and annular first metal structures, each multilateral and annular first metal structure being adjoined with the adjacent multilateral and annular first metal structures along a major axis, the overlapped region between two adjacent first metal structures corresponding to an underlying rib; and a second metal electrode installed on the front substrate in parallel with the first metal electrode, the second metal electrode being composed of a series of multilateral and annular second metal structures, each multilateral and annular second metal structure being adjoined with the adjacent multilateral and annular second metal structures along the major axis, the overlapped region between two adjacent second metal structures corresponding to an underlying rib;

wherein a discharge gap between each first metal structure and a corresponding second metal structure is substantially equal.

21. The PDP of claim 20 wherein the second, direction is substantially perpendicular to the first direction.

22. The PDP of claim 20 wherein the front substrate and the rear substrate are both transparent glass substrates.

23. The PDP of claim 20 wherein neither the first metal electrode nor the second metal electrode comprises transparent electrodes.

24. The PDP of claim 20 wherein the first metal electrode and the second metal electrode are both composed of chromium/copper/chromium (Cr/Cu/Cr) or silver (Ag).

25. The PDP of claim 20 wherein the first metal structures and the second metal structures both comprise triangular metal structures, quadrilateral metal structures, pentagonal metal structures, hexagonal metal structures, octagonal metal structures or semicircular metal structures.

26. The PDP of claim 20 wherein each of the first metal structures and the second metal structures further comprises a protrusion formed on a side away from the discharge gap for extending a discharge area of the electrode pair structure.

* * * * *